US006909247B2

(12) United States Patent
Ming

(10) Patent No.: US 6,909,247 B2
(45) Date of Patent: Jun. 21, 2005

(54) ELECTRICAL DISPLAY DEVICE WITH INDIVIDUAL DISPLAY MEMBERS

(75) Inventor: Tsang Chiu Ming, Kwai Chung (HK)

(73) Assignee: General-Tech Holdings Limited, Kwai Chung (HK)

( * ) Notice: Subject to any disclaimer, the term of this patent is extended or adjusted under 35 U.S.C. 154(b) by 3 days.

(21) Appl. No.: 10/624,343

(22) Filed: Jul. 22, 2003

(65) Prior Publication Data

US 2005/0017657 A1 Jan. 27, 2005

(51) Int. Cl.[7] ..... H05B 41/16

(52) U.S. Cl. ..... 315/276; 315/282; 315/312; 362/92

(58) Field of Search ..... 315/112, 118, 315/276, 282, 312, 358; 362/92, 125, 133, 224

(56) References Cited

U.S. PATENT DOCUMENTS 4,969,282 A * 11/1990 Eberhart ..... 40/545
5,025,355 A * 6/1991 Harwood ..... 362/147
6,188,185 B1 * 2/2001 Ter-Hovhannisian et al. .... 315/312

FOREIGN PATENT DOCUMENTS

AU WO 9421014 * 9/1994 ..... 315/282

* cited by examiner

*Primary Examiner*—Hoang V. Nguyen
*Assistant Examiner*—Jimmy Vu
(74) *Attorney, Agent, or Firm*—G. Brian Pingel; Camille L. Urban

(57) ABSTRACT

An electrical neon display device that allows for the interchangeability of the material being displayed and includes a power track, a track head and at least one display member that is semi-permanently electrically connected to said track head and includes a neon tube that is preferably shaped in the configuration of a desired letter or design to be displayed by said device.

18 Claims, 7 Drawing Sheets

ELECTRICAL DISPLAY DEVICE WITH INDIVIDUAL DISPLAY MEMBERS

BACKGROUND OF THE INVENTION

1. Field of the Invention

The present invention relates in general to electrical display signs that preferably include neon display elements and more specifically relates to a display sign that displays individual letters or designs and allows for the interchangeability of the letters or designs being displayed.

2. Description of the Prior Art

During at least the last decade, a form of electrical lighting commonly referred to as "track lighting" has become highly popular not only in commercial situations but also in residential environments. Typically, track lighting systems are formed with an H-track power strip into which are plugged incandescent or halogen light bulbs. Although the use of a variety of lighting systems that employ neon bulbs is well-known, up to this time neon bulbs have not been employed with track lighting systems.

It is also well-known in the art to use neon signs for use as exterior signage on buildings or advertising media to promote a business. Typical neon signs employ relatively expensive neon tubing that is generally formed in one piece to provide lighting for the display. Such neon signage not only is highly expensive, but is also difficult to produce or replace. Accordingly, the present invention is designed to provide a neon light display that preferably includes a plurality of individual lighting members.

SUMMARY OF THE INVENTION

The present invention provides an electrical neon display device that allows for the interchangeability of the display members employed in the device and includes an alternating current power track, a track head electrically connected to the power track, and at least one display member that is semi-permanently electrically connected to the track head.

Preferably the track head is semi-permanently electrically connected to the power track and serves as a housing for a transformer for converting alternating current received from the power track into direct current. Additionally, each display member includes a neon tube that serves as a source of light and will preferably be in the shape of a letter or design so that the display device can be used as signage for promoting a business or other activity.

The foregoing and other advantages of the present invention will appear from the following description. In the description, reference is made to the accompanying drawings, which form a part hereof, and in which there is shown by illustration and not of limitation specific forms in which the invention may be embodied. Such embodiments do not represent the full scope of the invention, but rather the invention may be employed in a variety of other embodiments and reference should be made to the claims herein for interpreting the breadth of the invention.

DETAILED DESCRIPTION OF THE PREFERRED EMBODIMENT

Figure 1:
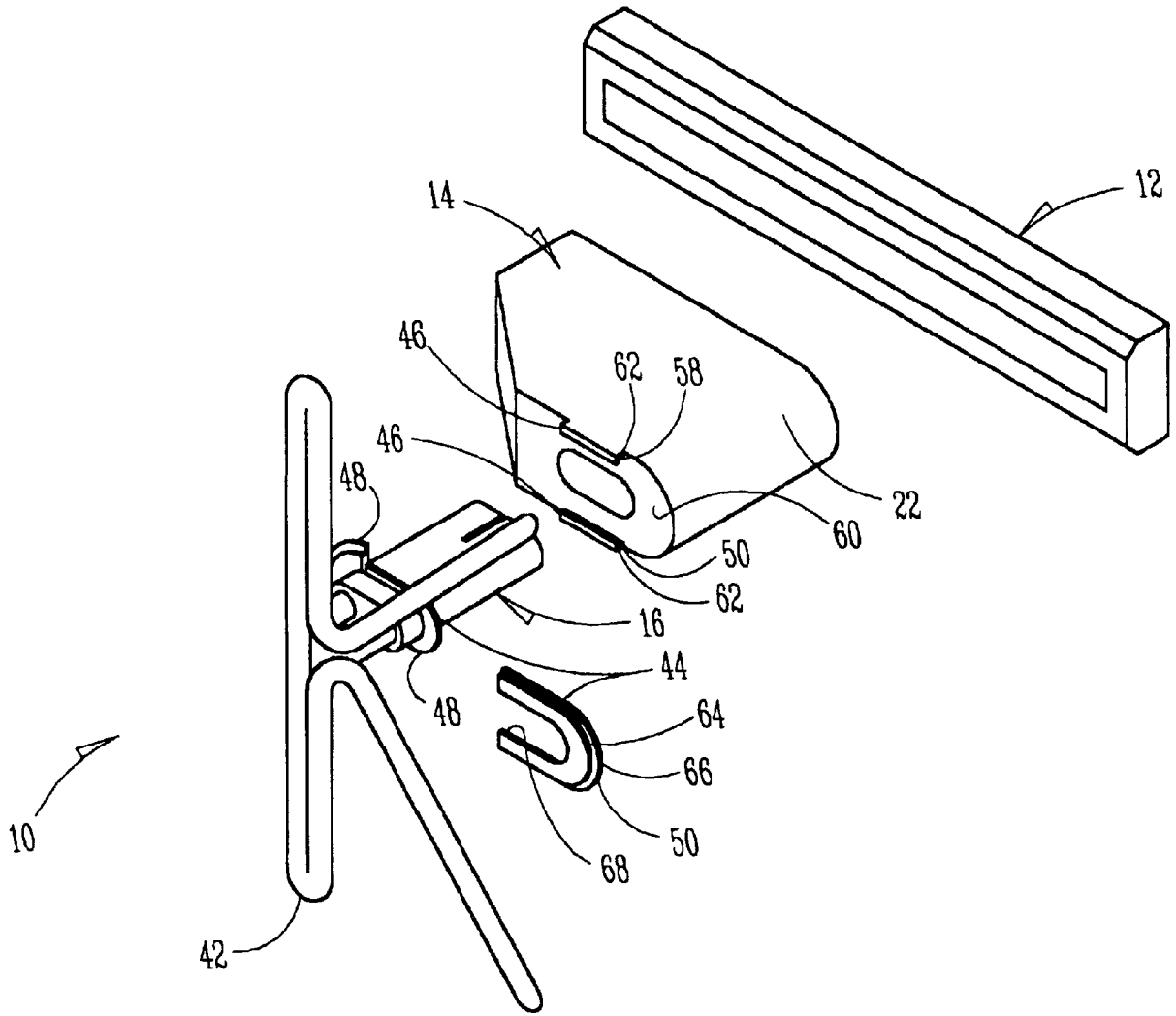
FIG. 1 is a front perspective view of a first embodiment of a neon display device of the present invention that includes a power track, a track head, and a display member shown in an exploded relationship.

Referring now to the drawings and with reference first to FIG. 1, a perspective view of a first preferred embodiment of an electrical neon display device of the present invention is shown at 10 that can be utilized in typical fashion as a track lighting display, but preferably is designed to be utilized as a display sign. The device 10 includes a source of alternating current electrical power in the form of a standard type "H" track 12, a track head 14, and a display member 16 in the form of the letter K. The dimensions of the power track 12 are not essential to the present invention as the track will be chosen in length to accommodate the number of track heads that are to be utilized in the device 10. Similarly, the "K" shape of the display member 16 is solely for the purpose of illustration as it is envisioned that the member 16 can be formed in almost any shape as desired.

Figure 2:
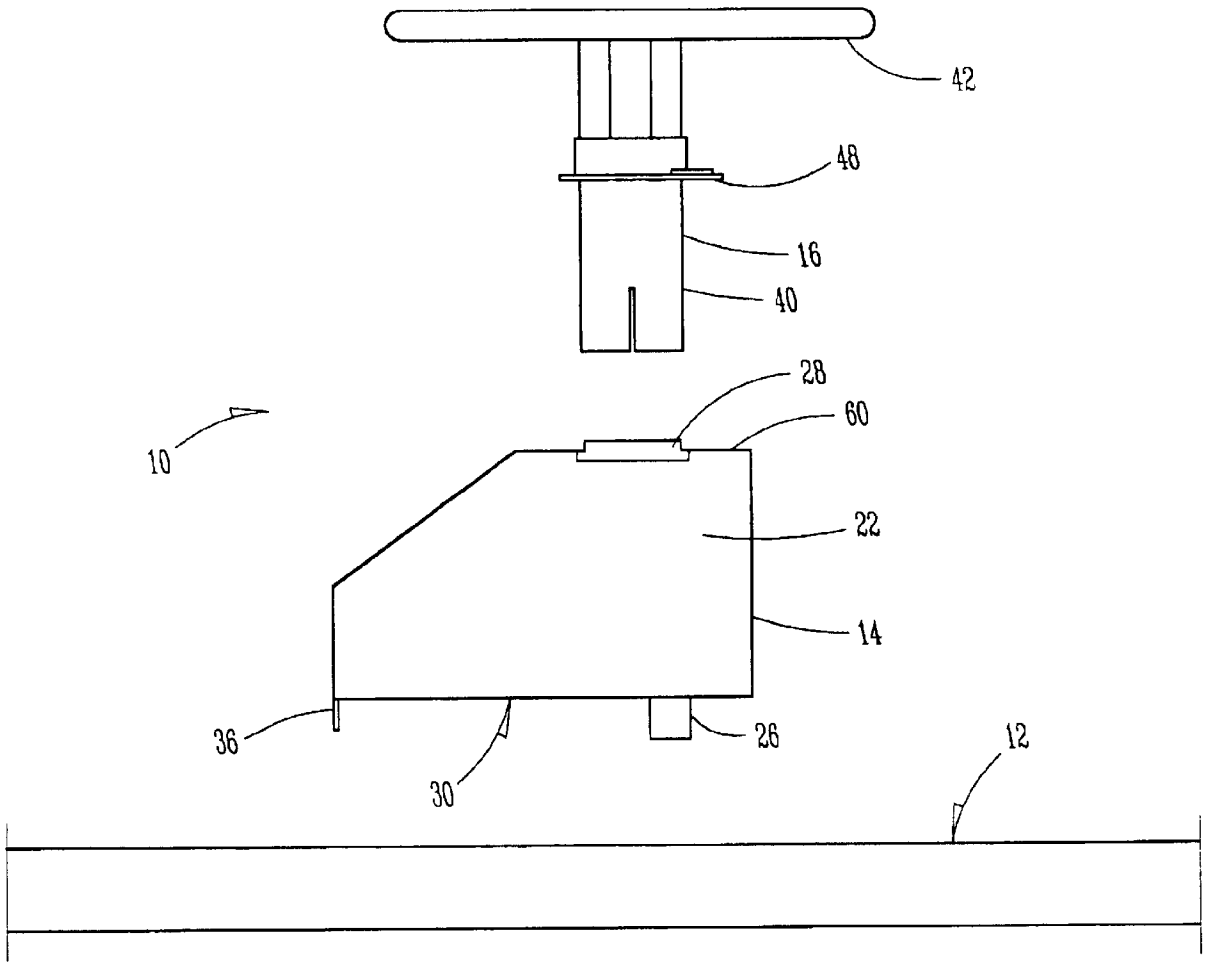
FIG. 2 is a side view in elevation of the embodiment shown in FIG. 1.
Figure 3:
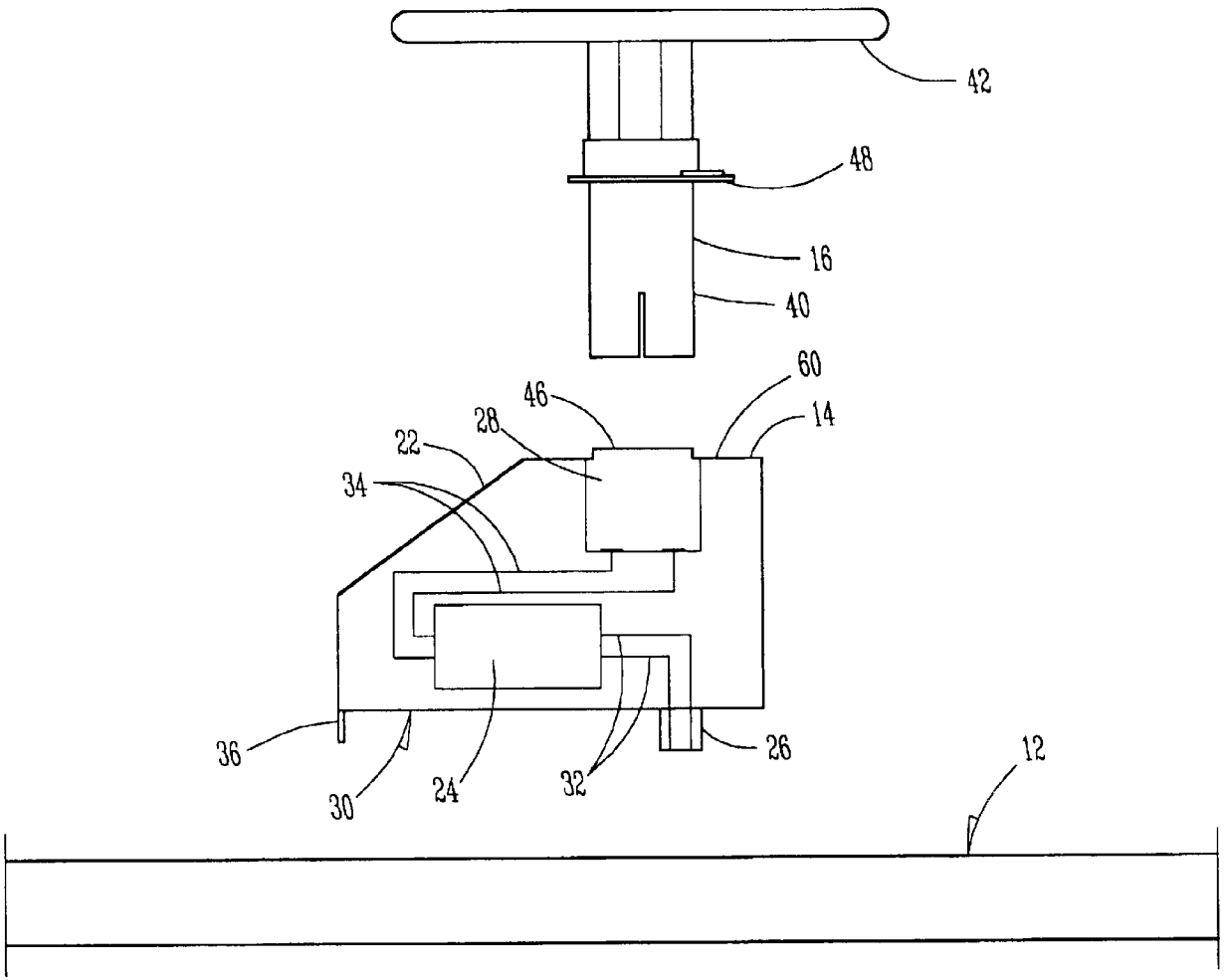
FIG. 3 is a side view in elevation similar to that of FIG. 2 but showing the internal components of the track head.

Referring now to FIGS. 1, 2, and 3, the track head 14 has a body portion 22 that serves as a relatively narrow housing for a transformer 24 (see FIG. 3) and electrical connectors 26 and 28. The electrical connector 26 is fixed to a bottom 30 of the track head body 22 and is in the form of a standard type electrical connector designed to coact with and electrically contact the power track 12 as is well-known in the art. The electrical connector 26 is an electrical contact with the transformer 24 via conductors 32. Thus, the alternating current received from the power track 12 is supplied to the transformer 12 and is converted into DC power, which is then supplied by conductors 34 to the electrical connector 28 that preferably is in the form of a female connector. However, it should be recognized by those skilled in the art that the specific form of the electrical connector 28 is not critical to the present invention and may alternatively be a male connector. The shape of the track head body 22 is also not critical to the present invention and the particular shape shown has been selected so that the transformer 24 and connectors 26 and 28 are easily accommodated within the body 22. Also, it is preferable that at least a portion of the bottom 30 of the body 22 be removable for replacement of the transformer, if needed, and that the bottom 30 also have an outwardly projecting tab 36 that acts to maintain the track head 14 in alignment with the track 12.

The display member 16 is formed of a male connector 40 on which is mounted a neon tube 42. Although as mentioned above, the tube 42 is in the shape of a K, it is contemplated that the tube 42 can be formed in a variety of shapes not only to provide lighting, if only lighting is desired, but also can be in the shape of letters or designs for use as a display sign for a business or attraction.

The male electrical connector 40 is of a shape and size to mate with the female connector 28 of the track head 14. Preferably the track head 14 and the display member 16 are semi-permanently joined together through the use of connecting means 44 formed by a pair of spaced apart ledges 46 on the top of the electrical connector 28, a flange assembly 48 located near the top of the connector 40, and a latch member 50 that is designed to coact with the ledges 46 and the flange assembly 48.

As best shown in FIG. 1, the ledges 46 on the track head 14 are each formed with a curved configuration so that their upper ends 58 are generally parallel to an upper surface 60 of the track head 14 to provide recesses 62 for a purpose to be described below.

Figure 7:
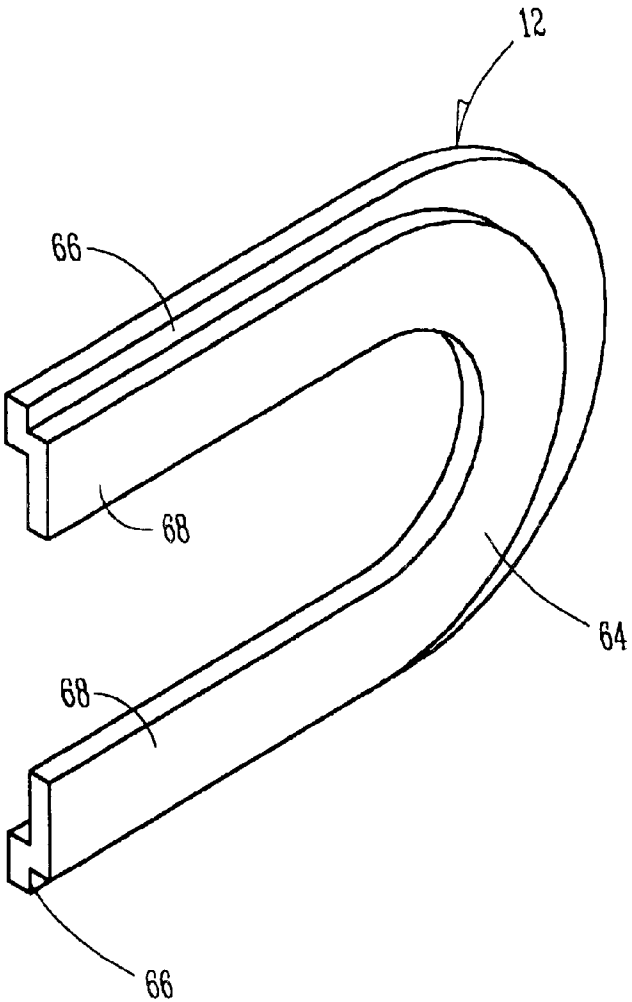
FIG. 7 is a perspective view of a latch member.

Referring to FIG. 7, the latch member 50 is formed with a generally U-shaped rail type structure 64 having somewhat of a "Z" shaped cross section to provide a lower flange structure 66 that is outwardly extending and an upper flange structure 68 that is inwardly extending.

To connect the display member 16 to the track head 14, the electrical connector 40 is positioned into the connector 28 until the connector flange assembly 48 lies flat against the upper surface of the connector 28. The latch member 50 is then slid into position with its lower flange structure 66 located in the recesses 62 formed by the ledges 46 and the upper flange structure 68 overlying the display member flange assembly 48. In this manner, the latch member 50 is held in position on the track head 14 by the ledges 46, and the latch member 50 in turn holds the display member 16 in position by means of its upper flange structure 68. As can be readily recognized, assembly of the track head 14 and display member 16 is readily accomplished through the use of the latch member 50 so that substitution of the display member 16 with another display member 16 can be readily and easily accomplished.

Figure 4:
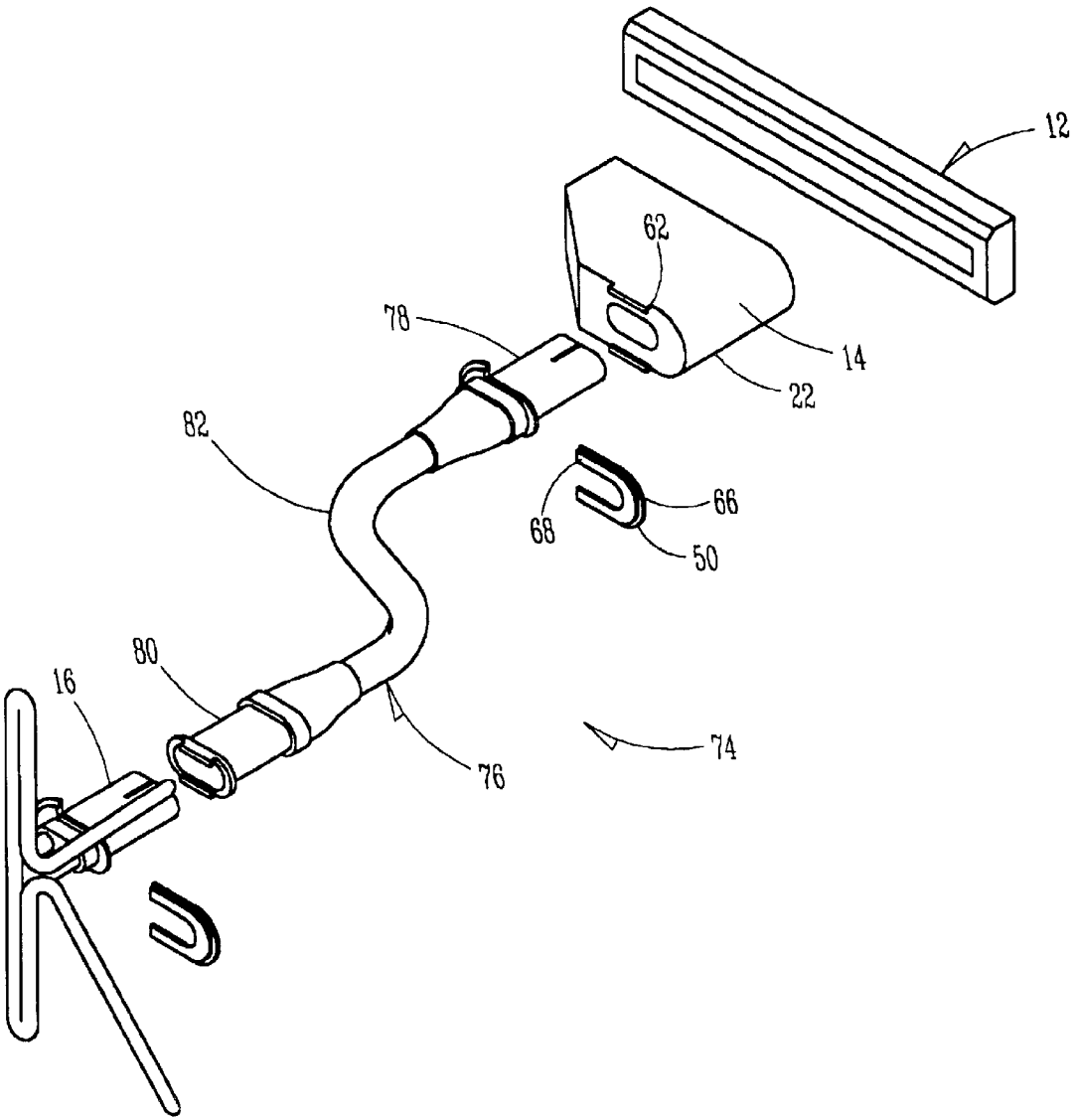
FIG. 4 is a perspective view of a second embodiment of the present invention that is similar to the first embodiment but includes an extension member.
Figure 5:
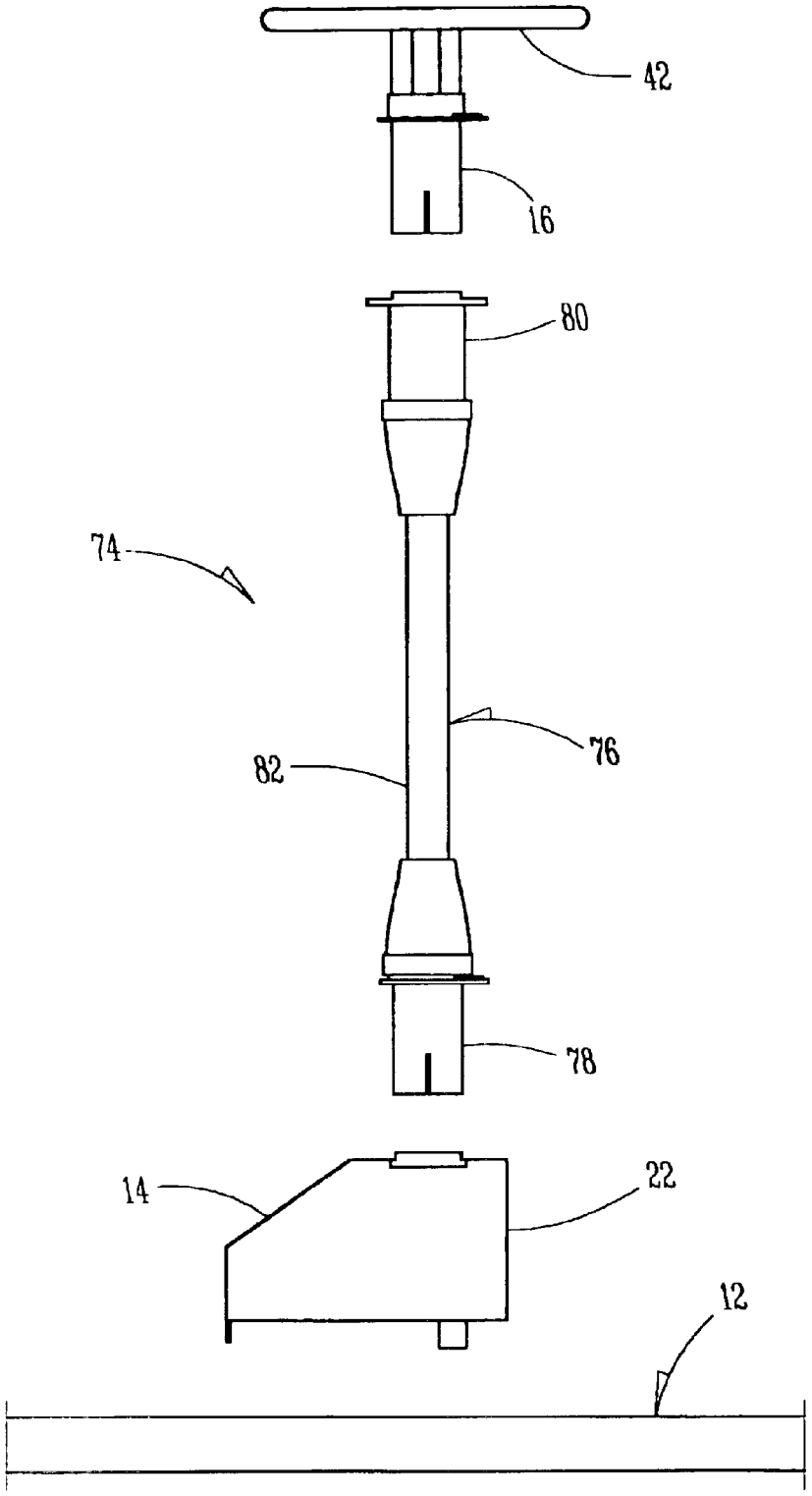
FIG. 5 is a side view in elevation of the embodiment of FIG. 4.
Figure 6:
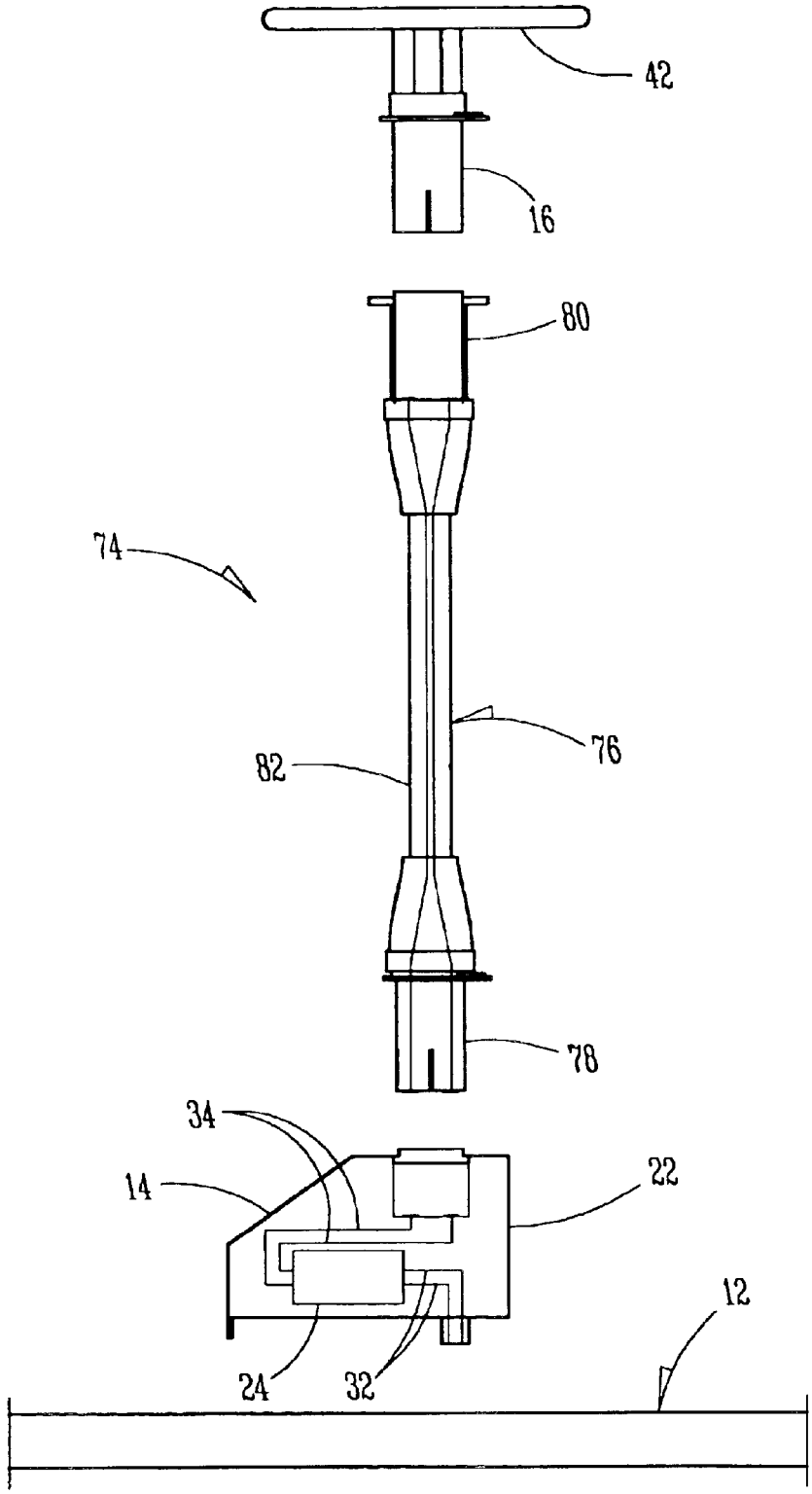
FIG. 6 is a side view in elevation similar to that of FIG. 5, but showing the internal components of the track head and extension member.

Referring now to FIGS. 4, 5 and 6, a second embodiment of the electrical display device of the present invention is shown at 74 and as can be readily perceived is similar to the first embodiment 10 in that it includes the power track 12, the track head 14 and the display member 16. However, the second embodiment 74 differs from the first embodiment by having a display member extension arm 76 positioned between the track head 14 and display member 16.

The extension arm 76 includes, on one end, a male electrical connector 78 that is similar to the connector 40 on the display member 28 and further includes, on the opposite end, an electrical connector 80 that is similar to the connector 28 on the track head 14. Interposed between the connectors 78 and 80 is a flexible tubing 82 that serves as a conduit for electrical wiring 84, see FIG. 6, that runs between the connectors 78 and 80.

The tubing 82, although being flexible, is somewhat rigid so that it can be bent to a particular configuration to locate one of its associated display member 16 as desired and will remain in such position until a different bending force is applied. Accordingly, by the use of the extension 76 a wide variety of display member placements can be achieved with the device 74.

As can be recognized from the above description, the present invention provides a novel, efficient and practical means for providing an electrical display that includes a plurality of individual display members. Although the display device of the present invention has been described with respect to two preferred embodiments, it should be understood that such embodiments may be altered without avoiding the true spirit and scope of the present invention. For example, a variety of different types of electrical connectors could be employed in forming the invention and a variety of shapes for the track head may also be utilized. It is also important to note that the use of individualized display members allows the display device to incorporate almost any type of particular term that is desired to be displayed and that a plurality of designs can also be formed by the present invention.

What is claimed is:

1. An electrical neon display device that allows for the interchangeability of the material being displayed, said device comprising:

(a) an alternating current power track;

(b) at least one neon track head that is removably attached and semi-permanently electrically connected to said track and housing a transformer for converting alternating current to direct current; and (c) at least one display member that is removably attached and semi-permanently electrically connected to said at least one track head.

2. The electrical neon display device as described in claim 1, wherein said device includes a plurality of individual display members removably attached and semipermanently electrically connected to a plurality of individual track heads.

3. The electrical neon display device as described in claim 2, wherein said display member includes a neon tube shaped in the configuration of a desired letter or design to be displayed by said device.

4. The electrical neon display device as described in claim 3, wherein said track head has one of a female electrical connector and a male electrical connector and said display member has an electrical connecting member opposite to that of the track head.

5. The electrical neon display device as described in claim 4, wherein said track head and said display member have coacting connecting means that are utilized to semi-permanently connect said track head and display member together.

6. The electrical neon display device as described in claim 5, wherein said connecting means further includes a latch member that is semi-permanently associated with said track head and said display member.

7. The electrical neon display device as described in claim 6, wherein said latch member is U-shaped.

8. The electrical neon display device as described in claim 1, wherein said device further includes a rigid extension member that is disposed between said track head and said display member.

9. The electrical neon display device as described in claim 8, wherein said extension member has a flexible body portion to allow for the movement of said display member with respect to said power strip.

10. The electrical neon display device as described in claim 9, wherein said extension member allows said display member to be pivoted at least ninety degrees with respect to said power track.

11. An electrical neon display device that allows for the interchangeability of the material being displayed, said device comprising:

(a) an alternating current power track;

(b) at least one neon track head that is removably attached and semi-permanently electrically connected to said track and housing a transformer for converting alternating current to direct current;

(c) at least one display member that is removably attached and semi-permanently electrically connected to said at least one track head;

(d) said track head and said display member have coacting connecting means that are utilized to semi-permanently connect said track head and display member together; and (e) said connecting means further includes a latch member that is semi-permanently associated with said track head and said display member.

12. The electrical neon display device as described in claim 11, wherein said latch member is U-shaped.

13. The electrical neon display device as described in claim 11, wherein said device further includes a rigid extension member that is disposed between said track head and said display member.

14. The electrical neon display device as described in claim 13, wherein said extension member has a flexible body portion to allow for the movement of said display member with respect to said power strip.

15. The electrical neon display device as described in claim 14, wherein said extension member allows said display member to be pivoted at least ninety degrees with respect to said power track.

16. The electrical neon display device as described in claim 11, wherein said device includes a plurality of individual display members removably attached and semipermanently electrically connected to a plurality of individual track heads.

17. The electrical neon display device as described in claim 16, wherein said display member includes a neon tube shaped in the configuration of a desired letter or design to be displayed by said device.

18. The electrical neon display device as described in claim 17, wherein said track head has one of a female electrical connector and a male electrical connector and said display member has an electrical connecting member opposite to that of the track head.

* * * * *